United States Patent [19]

Dente et al.

[11] 4,396,498

[45] Aug. 2, 1983

[54] TREATMENT OF HETEROGENEOUS LIQUID MATERIALS

[75] Inventors: Mario Dente; Aldo Corti, both of Milan; Livio Antonelli, Rome, all of Italy; George O. Jackson, Twickenham, England

[73] Assignee: RTR Riotinto Til Holding S.A., Lugano, Switzerland

[21] Appl. No.: 234,491

[22] Filed: Feb. 17, 1981

[30] Foreign Application Priority Data

Feb. 15, 1980 [IT] Italy ..... 67236 A/80

[51] Int. Cl.[3] ..... C10G 33/04

[52] U.S. Cl. ..... 208/188; 208/177; 208/11 LE

[58] Field of Search ..... 208/11 LE, 177, 188

[56] References Cited

U.S. PATENT DOCUMENTS

| | | | |
|---|---|---|---|
| 2,446,040 | 7/1948 | Blair, Jr. | 208/188 |
| 2,677,666 | 5/1954 | Dougherty | 208/177 |
| 2,968,603 | 1/1961 | Coulson | 208/11 LE |
| 3,331,765 | 7/1967 | Canevari et al. | 208/11 LE |
| 3,684,699 | 8/1972 | Vermeulen et al. | 208/188 |

*Primary Examiner*—Delbert E. Gantz
*Assistant Examiner*—O. Chaudhuri
*Attorney, Agent, or Firm*—Lee, Smith & Jager

[57] ABSTRACT

The invention relates to a continuous process for treatment of feed in the form of a heavy hydrocarbon-water dispersion or dispersions. The feed is diluted with a hydrocarbon solvent and contacted in a contactor with a water stream. A product stream containing bitumen oils and a discard stream comprising water and solids are separately removed from the contactor.

12 Claims, 1 Drawing Figure

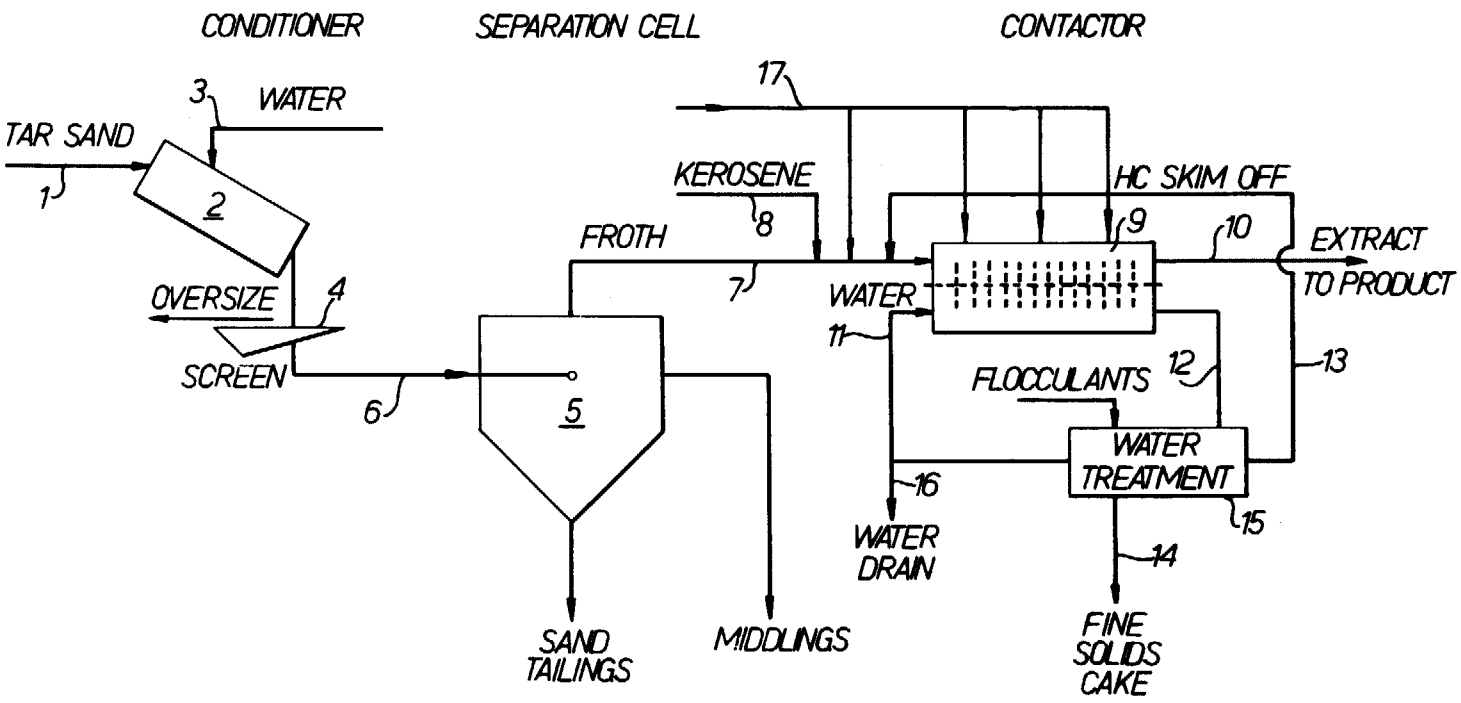
TAR SAND
1
CONDITIONER
2
WATER
3
OVERSIZE
4
SCREEN
6
SEPARATION CELL
5
FROTH
7
KEROSENE
8
17
CONTACTOR
HC SKIM OFF
9
10
EXTRACT
TO PRODUCT
13
WATER
11
FLOCCULANTS
12
WATER TREATMENT
15
14
FINE SOLIDS CAKE
16
WATER DRAIN
MIDDLINGS
SAND TAILINGS

TREATMENT OF HETEROGENEOUS LIQUID MATERIALS

This invention relates to a process for the continuous treatment of heterogeneous liquid materials such as a bituminous froth for the extraction of the bituminous constituents. That froth may for example be obtained in the first stage of the hot water process for extracting bitumen oils from tar sands. Tar sands of the type found in Athabasca (Canada) are conventionally processed in the hot water process firstly by conditioning with water at an appropriate temperature with the addition of steam and under alakaline conditions in order to separate the bitumen oil from tar sand.

In the conventional process, after the conditioning step, the resulting slurry is fed to a separation cell, where the bitumen floats upward and is removed from the surface as a froth product. This froth product, however, requires further treatment before it can be fed to the downstream upgrading plant, as it contains air and a noticeable quantity of water and solids. The froth which is recovered from the separation cell is therefore first of all heated and de-aerated, then diluted with naphtha and subsequently subjected to two-stage centrifugation. Between the two stages, de-emulsifiers may be added to the diluted hydrocarbon in order to improve the coalescence of small water droplets. This method of treating the froth, however, suffers from many disadvantages because (1) the required centrifuges are sophisticated devices with high investment and maintenance costs, (2) the process entails high energy consumption, and (3) the water and solids separated from the froth retain a certain amount of naphtha and bitumen oils, resulting in losses of a very valuable product and leaves, as a by-product, a polluted aqueous stream.

We have discovered that the bitumen froth which separates out of the tar sand slurry after conditioning with water, consists either of (1) a continuous phase of bituminous oil in which the water is dispersed in the form of a number of droplets of various size, or of (2) a continuous phase of water in which the bitumen is dispersed, or, even, (3) of a mixed system where the two dispersions (of water into oil and of oil into water) coexist and are present in any ratio. The so-called "froth" includes, further, air and a certain amount of finely divided solids, e.g. fine particles of sand, silt or clay materials, and other minerals of very small particle size.

Most of the solid material is dispersed in the aqueous phase (whether the aqueous phase is continuous or dispersed) and part of the solid material is present at the interface between the oil and the water.

The obstacles to the separation of the froth into two different continuous phases are therefore:

1. the low difference (if any) in the specific gravity between the bituminous oil and water: this difference of specific gravity is the main parameter enabling separation of the two phases,
2. the high viscosity of the bituminous oil, which is the controlling factor in those portions of the froth where the bituminous oil is the continuous phase and which hinder the water droplets to settle and to coalesce, and
3. the presence of dispersed solids in the water, and particularly at the water-oil interface, those solids hindering the coalescence of oil droplets dispersed in the continuous water phase.

Yet again, in other cases, such as the treatment of heavy oils recovered from heavy oil fields by steam stimulation, or other techniques, a chemical treatment may be employed in which the heavy oil, containing emulsified solids and water, is diluted with light hydrocarbons, mixed with a de-emulsifier and pumped through a static water layer prior to final heat treating and a long sedimentation period to separate the solids and water. However, this process too suffers from many disadvantages because (1) the treatment requires a very high dilution with light hydrocarbons and thus high diluent requirements to sufficiently decrease the specific gravity and viscosity of the mixture, (2) the settling time is high so that large storage settling tanks are required, and (3) the water and solids separated from the oil retain a certain amount of diluent and oil, resulting in losses of valuable products and the production as a by-product of a polluted aqueous stream.

The present invention resides in a continuous process for the treatment of a feed of heterogeneous liquid material in the form of a heavy hydrocarbon oil—water dispersion or dispersions, such as a bitumen froth; in that process the feed is diluted with a hydrocarbon solvent and is then contacted with a stream of water in a contactor, and a product stream containing the heavy hydrocarbon oil and a discard stream comprising water and solids are separately removed from the contactor at separate discharge points.

Preferably a de-emulsifier is added to the feed before its contact with water and/or at one or more points during the treatment in the contactor, in order to improve the coalescence between small water droplets which are otherwise difficult to eliminate. The addition of de-emulsifier is normally done before the diluted feed enters the contactor but other injection points may be arranged along the contactor for addition of de-emulsifier to the hydrocarbon phase. The amount of de-emulsifier added is preferably in the range of 10 to 2,000 ppm. Materials such as long chain alcohols, sulphonates and alkyl ammonium salts may be used as de-emulsifiers. Such materials are available commercially under such trade marks as Alchem, Emulsotron and Tret-O-Lite.

Of course other de-emulsifiers may be employed. Thus if soaps resulting from previously employed alkaline conditions such as used in the hot water process for tar sands extraction, are present, acidic de-emulsifiers can be usefully employed. Sequestering deflocculants, such as that known under the trade mark Calgon, may also be useful as de-emulsifiers in minimizing the problem of crud formation.

Preferably the contacting apparatus is of the type described in U.K. patent application No. 2026889A or U.S. Pat. No. 4,244,656 for example. As described in the above mentioned specifications, the contactor has rotary buckets. As the water stream passes through the contactor, the buckets repeatedly pick up the water and shower it through the stream of diluted froth; where the froth or any part of the froth is in the form of a continuous phase of bituminous oil with dispersed droplets of water, the falling drops of washing water capture the droplets of dispersed water including solids and drag them down into the water layer. On the downward movement of each bucket the diluted froth is carried down into the water and released to float upwardly, with two results: firstly, that part of the froth which contains a continuous phase of water with enclosed droplets of bitumen oil is dispersed in clean water and the solids, which hinder the coalescence of the bitumen drops, are diluted in clean water, thus reducing their ability to resist coalescence, and, secondly, that part of the froth, in which the continuous phase is bitumen oil or the solvent, is released in the form of large drops of hydrocarbon which move upward and tend to capture and coalesce the dispersed droplets of bitumen oil. The contactor should not rotate too rapidly as to agitate the contents unduly and to form an emulsion therein and the speed of rotation should be such that a clear interface between the hydrocarbon phase and the washing water phase is maintained.

The intimate contact which is obtained between the two streams without undue agitation results in the production of a product stream of bitumen oil and solvent which contains a very small quantity of water and solids. The water stream leaving the contactor carries with it solids which have been removed from the froth and only a small amount of hydrocarbon. Because of the nature of the process which is characterized by a low input of energy, the physico-chemical characteristics of the aqueous dispersion of the discard stream are such that the water can be purified in known manner and recycled to the process. In order to maintain a constant quantity of water in the circuit, a stream of purified water is drawn off.

Preferably the bitumen froth is diluted with a lighter hydrocarbon stream (such as e.g. kerosene or naphtha) in order to reduce the specific gravity and/or the viscosity of the total hydrocarbon stream fed to the contactor. The specific gravity at the operating temperature of the diluted froth in the product stream advantageously lies in the range 0.85–0.94 and the viscosity, at the same temperature, should be at maximum 100 centipoise and preferably less than 50 centipoise. The water stream and the diluted froth preferably pass co-currently through the contactor. The water flowrate is conveniently in the ratio of 0.25 to 1.0 (on weight basis) to that of the diluted froth.

Typically the bitumen froth contains water in a ratio to the bitumen ranging from 50 to 100% (on weight basis) and solids in a ratio to the bitumen ranging from 6 to 20% (on weight basis); even higher figures may obtain. Through the process which is the subject of this invention the product stream may have a water content in the ratio to the bitumen ranging from 5 to 20% and a solid content in a ratio to the bitumen in the range 0.5 to 2% (on weight basis), or even lower according to the nature of the solids which are contained in the feed stock.

The invention will be more readily understood from the following description, by way of example, of a process for water washing bitumen froth, reference being made to the accompanying drawing, where a flow diagram of one form of the process is presented.

The bitumen froth to be treated can be produced from mined tar sands by the hot water process in the following way. Raw tar sand, suitably broken down, is fed at 1 into a rotary conditioner 2, where it is mixed with hot water through line 3 and broken down into slurry form. Steam may be added to the conditioner 2. The slurry of tar sand in water exiting from conditioner 2 flows over a scalping screen 4, which removes foreign bodies, and then is fed through line 6 to a separation cell 5, where three layers are formed:

(1) an upper layer of bitumen froth
(2) an intermediate layer (middlings) being a suspension of fine minerals and bitumen in water
(3) a lower layer of sand.

The present invention relates to the treatment of the layer of bitumen froth derived from the separation cell 5.

The bitumen froth is withdrawn from the separation cell 5 through line 7 and is mixed with kerosene from line 8 to form a diluted froth which is then fed to the contactor 9, the stream entering the contactor near the top of the unit. De-emulsifier is added to the diluted froth through line 17 before entering the contactor and/or at other points along the contactor. The contactor 9 is generally as described in U.K. patent specification No. 2026889A, to which reference should be made. That contactor consists of a shell in which a rotor is mounted for rotation about its near horizontal axis. The rotor may be secured for rotation with the shell which in that case is mounted for rotation, or the rotor may rotate relative to the shell which is stationary. The rotor includes a number of axially-spaced circular discs which separate the interior of the shell into a series of compartments. The edge of each disc is spaced from the wall of the shell so that adjacent compartments are in communication via annular gaps between the discs and shell. In each compartment, there are a series of spaced buckets or receptacles which are carried between the discs of that compartment.

The diluted froth enters the contactor 9 as a feed stream at one end of the contactor, passes progressively from compartment to compartment of the contactor via the circumferential gaps and is discharged as a product stream through a line 10 at the top of the other end of the contactor. At the same time a water stream is passed through the contactor. Although the water stream may be countercurrent with respect to the froth, it is shown in the drawing as passing co-currently, being introduced on line 11 into the bottom of the contactor 9 and discharged as a discard stream through line 12 at the bottom of the end of the contactor.

The bitumen oil solution from the contactor 9 is directed on line 10 to a storage tank, from which it is passed to a solvent recovery plant which separates the solvent from the bitumen oils and recycles the solvent back to a solvent tank supplying line 8. The discard stream from the contactor 9 is fed on line 12 to a water treatment plant 15, which removes the hydrocarbons carried over with the washing water and separates out the fine solids by flocculation and subsequent centrifuging. The hydrocarbon stream removed in the water treatment plant is recycled through line 13 to the feed stream entering contactor 9 and the remaining solids are discarded as a semisolid cake through line 14.

The major part of the clean water resulting from the water treatment plant 15 is recycled to the contactor via line 11 and constitutes the water stream. A proportion of the water is withdrawin at 16, in order to maintain constant the amount of water in circuit in the process: the quantity of water withdrawn at 16 is almost equal to that transferred from the diluted froth into the washing water in the contactor 9.

The following table shows the constitution by weight of the various streams in the FIGURE, based on a tar sand aggregate weight of 100:

TABLE

MATERIAL BALANCE
BASIC TAR SAND = 100

| STREAM No. STREAM | 1 TAR SAND | 7 FROTH | 8 SOLVENT | 7 + 8 + 13 CONTACTOR FEED | 10 PRODUCT | 11 WASHING WATER | 12 WATER OUT | 13 HC SKIM OFF | 14 FINES CAKE | 16 WATER DRAIN |
|---|---|---|---|---|---|---|---|---|---|---|
| Bitumen | 14.3 | 13.3 | — | 13.386 | 13.286 | — | .1 | .086 | .014 | — |
| Water | 5.0 | 8.1 | — | 8.24 | 1.5 | 15.79 | 22.53 | .14 | .47 | 6.13 |
| Sand | 65.7 | .8 | — | .8 | — | — | .8 | — | .8 | — |
| Fines | 15.0 | .5 | — | .52 | .12 | — | .4 | .02 | .38 | — |
| Kerosene | — | — | 8.87 | 8.829 | 8.859 | — | .07 | .059 | .011 | — |
| TOTAL | 100.0 | 22.7 | 8.87 | 31.875 | 23.765 | 15.79 | 23.9 | .305 | 1.675 | 6.13 |

The bitumen yield is in excess of 98% while the loss of solvent (kerosene) is usually little over 1%.

We claim:

1. A continuous process for the treatment of a feed stream of heterogeneous liquid material in the form of a heavy hydrocarbon-water dispersion or dispersions, in which process the feed is diluted with a hydrocarbon solvent, water and solids are removed from the diluted feed stream in a single stage by contacting the feed stream with a stream of water in a contactor in which the two streams move in discrete adjacent, continuous phases and in which water from the water phase is repeatedly showered through the feed phase and feed from the feed phase is repeatedly showered through the water phase, and a product stream containing the hydrocarbon and a discard stream comprising water and solids are separately removed from the contactor at separate discharge points.

2. A process according to claim 1, in which the feed material is a bitumen froth obtained from tar sand or from other hydrocarbon impregnated material.

3. A process according to claim 2, in which the quantity of solvent added to the bitumen froth is such that the specific gravity of the diluted froth in the product stream is less than 0.94.

4. A process according to claim 2, in which the flow rate of the water stream is in the ratio of 0.25 to 1.0 (on weight basis) to that of the diluted froth.

5. A process according to claim 2, in which the temperature of the treatment within the contactor is between 50° C. and 100° C.

6. A process according to claim 2, in which the water content of the bitumen froth is reduced to 5 to 20 weight percent of the bitumen content of the product stream.

7. A process according to claim 2, in which the solids content of bitumen froth is reduced to 0.5 to 2 weight percent of the bitumen content of the product stream.

8. A process according to claim 2, in which the contactor is of the low-speed rotary tape, having series of buckets which rotate to disperse the bitumen froth in the water stream and shower water from the water stream into the bitumen froth.

9. A process according to claim 1, in which a de-emulsifier is added to the feed before its contact with water and/or at one or more points during the treatment in the contactor.

10. A process according to claim 9, in which the amount of de-emulsifier added is in the range of 10 to 2,000 ppm.

11. A continuous process for the treatment of a feed stream of heterogeneous liquid material in the form of a heavy hydrocarbon-water dispersion or dispersions including fine solids, the process comprising:

(a) diluting said feed stream with a hydrocarbon solvent and thereby forming a diluted stream having a specific gravity below the specific gravity of water;

(b) contacting said diluted stream in a contactor with a water stream, the flow rate of which is in the ratio of 0.25 to 1.0 (on a weight ratio) to the flow rate of said feed stream;

(c) said diluted and water streams passing through said contactor in discrete adjacent, continuous phases;

(d) during the passage of said streams through said contactor, repeatedly showering said water from said water stream through said diluted stream and hydrocarbon from said diluted stream through said water stream whereby water and solids dispersed in said diluted stream are captured by said water stream; and (e) separately removing from said contactor at separate discharge points a product stream containing said diluted stream having a reduced water and solids content and a discard stream comprising water and solids.

12. A continuous process for the treatment of a feed of oil and water emulsion containing water in a ratio to oil ranging from 50 to 100% by weight and solids in a ratio to oil ranging from 6 to 20% by weight, and process comprising:

(a) diluting said emulsion with a light hydrocarbon in an amount to bring the specific gravity of said feed to the range of 0.85 to 0.94 and the viscosity of said feed to less than 50 centipoises at an operating temperature of 50° to 100° C., (b) adding to said diluted feed with 10 to 2000 ppm of a demulsifier, and (c) contacting said diluted and demulsified feed in a contactor of the low-speed rotary type provided with buckets with a water stream, the ratio of said water to said diluted and demulsified feed being between 0.25 and 1.0 by weight, and in which said diluted and demulsified feed and said water move in discrete adjacent, continuous phases and in which water from the water phase is repeatedly showered through the feed phase and feed from the feed phase is repeatedly showered through the water phase, (d) whereby the water content in the treated feed is reduced to 5 to 20% and the solids content to 0.5 to 2% by weight of said emulsion feed.

* * * * *